US007769332B2

(12) United States Patent
Yamamoto et al.

(10) Patent No.: US 7,769,332 B2
(45) Date of Patent: Aug. 3, 2010

(54) PRESSURIZING UNIT, FIXING DEVICE, AND IMAGE FORMING APPARATUS

(75) Inventors: Shin Yamamoto, Osaka (JP); Yutaka Naito, Hyogo (JP); Toshio Ogiso, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 114 days.

(21) Appl. No.: 11/842,564

(22) Filed: Aug. 21, 2007

(65) Prior Publication Data

US 2008/0056783 A1 Mar. 6, 2008

(30) Foreign Application Priority Data

Aug. 31, 2006 (JP) ..... 2006-234977

(51) Int. Cl.
*G03G 15/20* (2006.01)

(52) U.S. Cl. ..... 399/329

(58) Field of Classification Search ..... 399/329, 399/331

See application file for complete search history.

(56) References Cited

U.S. PATENT DOCUMENTS 5,148,226 A * 9/1992 Setoriyama et al. ..... 399/329
5,666,624 A * 9/1997 Kanesawa et al. ..... 399/329
2002/0141796 A1* 10/2002 Nishitani et al. ..... 399/328
2005/0249531 A1* 11/2005 Chung et al. ..... 399/328
2006/0233575 A1* 10/2006 Uchida et al. ..... 399/329
2007/0140752 A1 6/2007 Yamamoto et al.
2007/0172278 A1 7/2007 Yamamoto

FOREIGN PATENT DOCUMENTS

JP 2000-87932 3/2000
JP 3298354 4/2002
JP 2004-191857 7/2004
JP 2005-164721 6/2005

* cited by examiner

*Primary Examiner*—David M Gray
*Assistant Examiner*—Billy J Lactaoen
(74) *Attorney, Agent, or Firm*—Oblon, Spivak, McClelland, Maier & Neustadt, L.L.P.

(57) ABSTRACT

A pressurizing unit includes a contact-pressure member for pressurizing an endless belt, a holding member that holds the contact-pressure member, and a biasing member that presses both ends of the holding member. The biasing member presses the holding member, so that a direction in which the biasing member presses the holding member is substantially the same as a direction in which the holding member presses the pressure-contact member.

9 Claims, 4 Drawing Sheets

PRESSURIZING UNIT, FIXING DEVICE, AND IMAGE FORMING APPARATUS

CROSS-REFERENCE TO RELATED APPLICATIONS

The present application claims priority to and incorporates by reference the entire contents of Japanese priority document, 2006-234977 filed in Japan on Aug. 31, 2006.

BACKGROUND OF THE INVENTION

1. Field of the Invention

The present invention relates to a pressurizing unit, a fixing device, and an image forming apparatus.

2. Description of the Related Art

Image forming apparatuses such as a copier, a printer, a facsimile machine, and a multifunction product includes a fixing device for fusing a toner image on a recording medium. Among various technologies that have been proposed in relation to such a fixing device is a fixing device disclosed in Japanese Patent No. 3298354. The fixing device employs a belt-nip system in which a rotatable heating roller with an elastically deformable surface is brought into pressure contact with a pressurizing unit to form a nip portion. While a recording medium is passing through the nip portion, a toner image on the recording medium is pressed and heated, and is thereby fixed on the recording medium. The pressurizing unit elastically deforms a portion of the heating roller corresponding to an exit portion (hereinafter, "nip exit") of the nip portion, from which a recording medium exits.

In the belt-nip system, however, the local deformation at the nip exit changes the surface speed of the heating roller, and thus, shift of an image on the recording medium tends to occur. In addition, because a nip portion having a small curvature is formed by pressing an elastic layer of the heating roller and locally deforming the elastic layer, a heavy load is imposed on the recording medium, which increases an amount of damage on the recording medium or curling of the recording medium Reference may be had to Japanese Patent Application Laid-open No. 2005-164721.

A roller-nip system is also known, in which both ends of a metal core of a pressurizing roller is pressurized to form a nip portion. Whereas, in the belt-nip system, a pressurizing unit pressurizes a stationary member, which prevents an endless member from deviating.

A typical fixing device includes a heating unit and a pressurizing unit. A pressurizing unit of the belt-nip system includes a biasing member, a stationary member, a holding member, a pressure-contact member, and an endless member that is pressurized by the pressure-contact member. The biasing member presses the stationary member to form a nip portion between the pressurizing unit and the heating unit. If the mounting error occurs between the stationary member and the holding member, a direction in which the biasing member presses the stationary member can be different from a direction in which the holding member presses the pressure-contact member that pressurizes the endless member. Accordingly, sufficient nip pressure cannot be obtained. In addition, because the biasing member directly presses the stationary member, the stationary member may be damaged.

In most of the roller-nip systems, the whole outer surfaces of both ends of a metal core of a pressurizing roller is pressurized, so that the direction in which the both ends of metal core are pressed is substantially the same as the direction in which the pressurizing roller pressurizes the heating roller at the nip portion. Therefore, an appropriate nip portion can be formed. Whereas, in the belt-nip systems in which an endless member such as a belt is used, the direction in which the biasing member presses the stationary member is sometimes different from the direction in which the holding member presses the pressure-contact member, leading to a degraded image.

For removing a sheet by releasing nipping at the time of jamming, a pressure removing mechanism is required to release the pressure applied by the pressurizing member. The pressure removing mechanism, however, occupies space and increases the number of parts in the fixing device.

SUMMARY OF THE INVENTION

It is an object of the present invention to at least partially solve the problems in the conventional technology.

According to an aspect of the present invention, a pressurizing unit that presses an endless belt that carries a recording medium includes a contact-pressure member that presses the endless belt, a holding member that holds the contact-pressure member, and a biasing member that presses both ends of the holding member so that a direction in which the biasing member presses the holding member is substantially identical with a direction in which the holding member presses the pressure-contact member.

According to another aspect of the present invention, a fixing device that fixes a toner image on a recording medium carried on an endless belt by heat and pressure includes a heating unit that includes an elastic layer and a heat source, a pressurizing unit that forms a nip portion with the heating unit through which the recording medium passes. The pressurizing unit includes a contact-pressure member that pressurizes the endless belt, a holding member that holds the contact-pressure member, and a biasing member that presses both ends of the holding member so that a direction in which the biasing member presses the holding member is substantially identical with a direction in which the holding member presses the pressure-contact member.

According to still another aspect of the present invention, an image forming apparatus includes a fixing device that fixes a toner image on a recording medium carried on an endless belt by heat and pressure. The fixing device includes a heating unit that includes an elastic layer and a heat source, a pressurizing unit that forms a nip portion with the heating unit through which the recording medium passes. The pressurizing unit includes a contact-pressure member that pressurizes the endless belt, a holding member that holds the contact-pressure member, and a biasing member that presses both ends of the holding member so that a direction in which the biasing member presses the holding member is substantially identical with a direction in which the holding member presses the pressure-contact member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
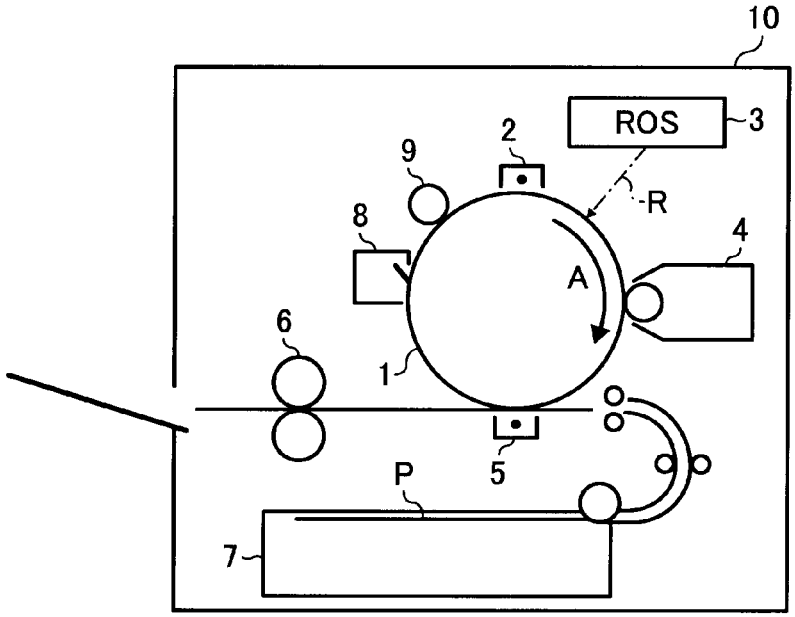
FIG. 1 is a schematic diagram of an electrophotographic image forming apparatus according to an embodiment of the present invention.

FIG. 1 is a schematic diagram of an image forming apparatus 10 according to an embodiment of the present invention. The image forming apparatus 10 includes a photoreceptor 1, a scorotron charging unit 2, a raster output scanner (ROS) 3, a developing unit 4, a transfer unit 5, a fixing device 6, a sheet tray 7, a cleaner 8, and a removing unit 9. The photoreceptor 1 rotates in the direction indicated by an arrow A shown in FIG. 1. The scorotron charging unit 2 electrically charges the surface of the photoreceptor 1. The ROS 3 forms an electrostatic latent image on the surface of the photoreceptor 1 by exposing the surface with a ray R of light modulated with information on an image. The developing unit 4 develops the electrostatic latent image on the surface of the photoreceptor 1 into a toner image with toner. The transfer unit 5 transfers the toner image on the surface of the photoreceptor 1 to a sheet P. The fixing device 6 fixes the toner image on the sheet P. The sheet tray 7 contains the sheets P. The cleaner 8 cleans the surface of the photoreceptor 1. The removing unit 9 removes residual static electricity residing on the surface of the photoreceptor 1.

Operations of the image forming apparatus 10 for forming an image are explained below with reference to FIG. 1. First, an original image signal read from an original by an image reading unit (not shown), or an original image signal generated by, for example, an external computer (not shown) is input to an image processing unit (not shown). The image processing unit generates an input image signal from the original image signal, and outputs it to the ROS 3. The ROS 3 modulates the ray R, and scans the surface of the photoreceptor 1 that is uniformly electrically charged by the scorotron charging unit 2 with the modulated ray R in a raster manner. With this raster scanning, an electrostatic latent image that corresponds to the input image signal is formed on the surface of the photoreceptor 1.

The developing unit 4 develops the electrostatic latent image on the surface of the photoreceptor 1 into a toner image with toner. With the rotation of the photoreceptor 1, the toner image is conveyed to the transfer unit 5 that is arranged to be opposed to the photoreceptor 1.

Meanwhile, the sheet P stored in the sheet tray 7 is fed to a nip portion between the photoreceptor 1 and the transfer unit 5. The transfer unit 5 transfers the toner image from the surface of the photoreceptor 1 to the sheet P. The sheet P with the toner image thereon is conveyed to the fixing device 6, and the fixing device 6 fixes the toner image. In this manner, a desired image is obtained.

After the transfer of the toner image to the sheet P, the cleaner 8 cleans a material, such as toner, adhered on the surface of the photoreceptor 1. The removing unit 9 removes the residual static electricity residing on the surface of the photoreceptor 1. In this manner, one cycle of the operations for forming an image is completed.

Figure 2:
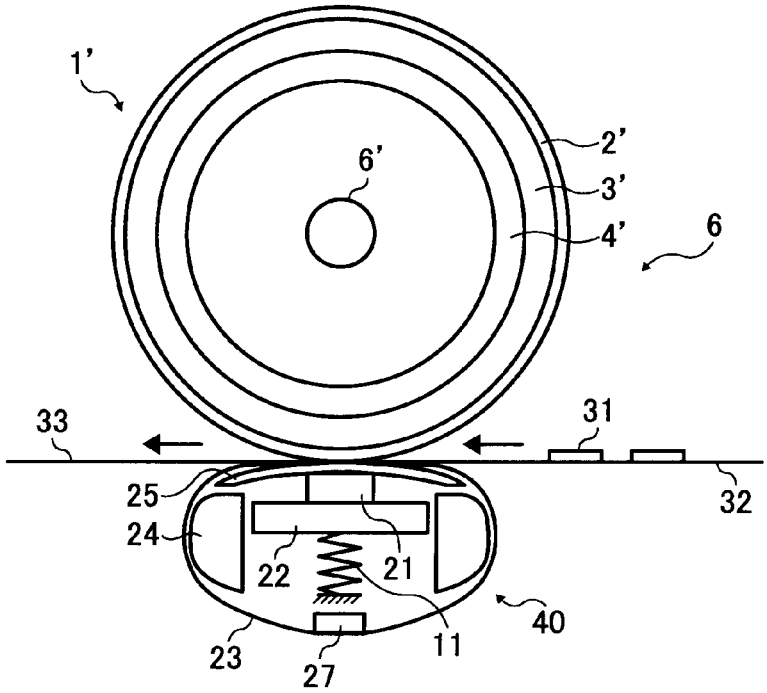
FIG. 2 is a schematic diagram of a fixing device shown in FIG. 1.

FIG. 2 is a schematic diagram of the fixing device 6. The fixing device 6 includes a heating-fixing roller 1'. The heating-fixing roller 1' includes a surface-covering layer 2', an elastic layer 3', a core 4, and a heat source 6'. The heating-fixing roller 1' is driven to rotate.

A recording medium 32 with unfixed toner 31 on its surface is conveyed in the direction indicated by an arrow shown in FIG. 2. The recording medium 32 passes between the heating-fixing roller 1' and a pressurizing unit 40.

The pressurizing unit 40 includes a pressurizing member 21, a supporting member 22 that supports the pressurizing member 21, a pressing spring 11, an endless member 23, a friction-reducing member 25, and guiding members 24. The pressing spring 11 presses the pressurizing member 21 and the supporting member 22 against the recording medium 32. The endless member 23 is driven to rotate. The friction-reducing member 25 reduces friction between the endless member 23 and the pressurizing member 21. The guiding members 24 define a path of the endless member 23.

The pressurizing unit 40 also includes a lubricant-supplying member 27 that supplies a lubricant for further reducing friction between the endless member 23 and the pressurizing member 21. As the lubricant, one containing silicone oil or fluorine oil is generally used.

A fixed image 33 is obtained after the recording medium 32 passes through a nip portion formed between the heating-fixing roller 1' and the endless member 23. As the surface-covering layer 2', for example, a tetrafluoroethylene perfluoroalkoxy vinyl ether copolymer (PFA) layer is used to inhibit the unfixed toner 31 from adhering to the heating-fixing roller 1'. As the elastic layer 3', for example, silicone rubber or fluororubber is generally used. When silicone rubber is used, the elastic layer 3' may be coated with, for example, a fluorine layer or the like to improve swelling resistance.

The endless member 23 is made of PFA and polyimide. As the pressurizing member 21 is used a pressurizing pad with a flat surface in a pressurizing direction. The pressurizing member 21 includes a rubber layer formed of silicone rubber or fluorine rubber. The recording medium 32 can be any type of recording medium such as a cut sheet.

Figure 3:
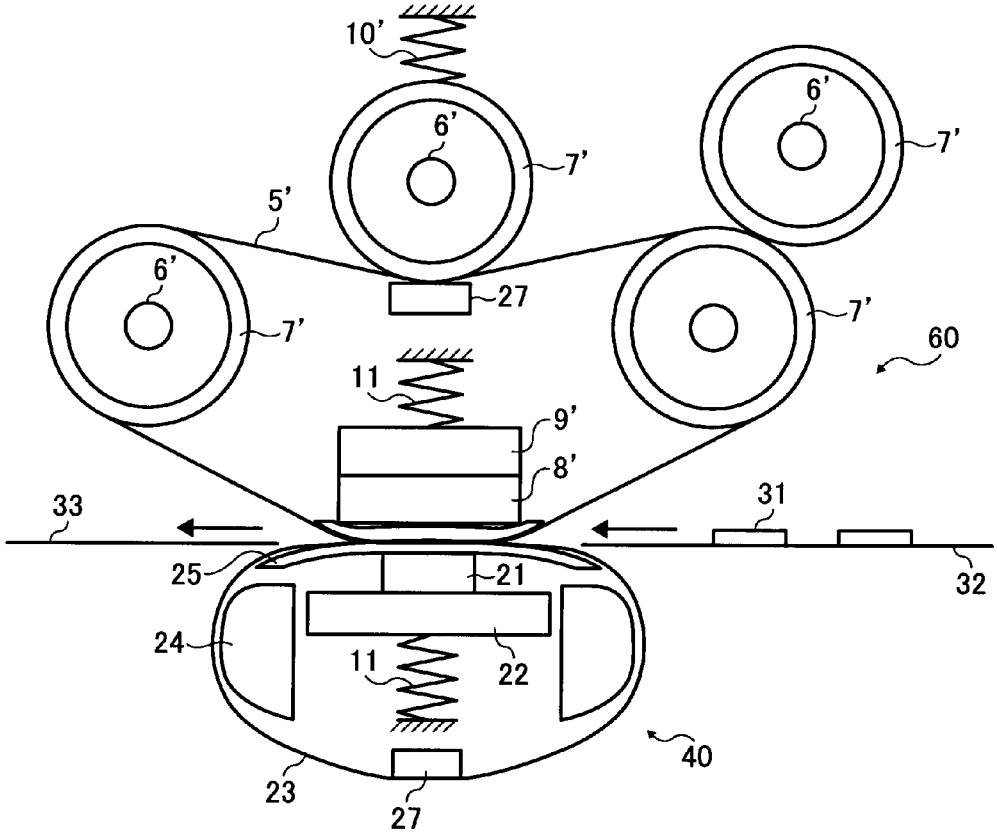
FIG. 3 is a schematic diagram of a modification of the fixing device.

FIG. 3 is a schematic diagram of a fixing device 60 that is a modification of the fixing device 6 shown in FIG. 2. The components of the fixing device 60 which are the same as those of the fixing device 6 are given the same reference numerals. The fixing device 60 includes an endless heating member 5', heating rollers 71, a pressurizing member 8', and a supporting member 9'. The endless heating member 5' is arranged to oppose one side of the recording medium 32 to which the unfixed toner 31 is adhered. The heating rollers 7' stretch and heat the endless heating member 5'. The pressurizing member 8' includes an elastic layer, and is supported by the supporting member 9'. If heat applied to the endless heating member 5' is insufficient, the heating roller 7' can be brought into contact with the endless heating member 5' from the outside to heat the endless heating member 5'.

In the fixing device 60, the heating rollers 7' serve as driving sources and directly drive the endless heating member 5'. Alternatively, the endless heating member 5' can be driven via a driven roller without heat source. The use of the endless heating member 5' instead of the heating-fixing roller 1' allows adjustment of the width of a nip and the deformation of the endless heating member 5' at the nip exit with little change in the size of the fixing device 60. In this case, the width of the pressurizing member 21 needs to be equal to or smaller than the width of the heating member 8'.

Tests performed in the embodiment are explained below. In the tests, the fixing device including the pressurizing member having an elastic (rubber) layer with a hardness of 8 Hs (JIS-A), a permanent deformation of 4%, and a thickness of 4 mm in a direction of load applied thereto (hereinafter, load application direction) was examined. The tests proved that a recording medium was easily separated from the fixing roller (i.e., the sheet releasability was improved) when the thickness in the load application direction is changed to 2 mm. If the permanent deformation of the elastic layer of the heating-fixing roller is large, the surface of the heating-fixing roller may locally deform, and image deterioration, such as uneven gloss of an image, may be caused. It was found that a permanent deformation equal to or more than 5% increased the amount of uneven gloss of an image. Thus, a permanent deformation equal to or less than 4% is desirable. Based on the idea that a large clearance between the surface of the heating-fixing roller and the surface of a sheet passing through the nip exit improves the sheet releasability, it can be understood that the outer diameter of the heating-fixing roller is a parameter for defining the clearance. It was found that an outer diameter ϕ of more than 28 mm lowered the sheet releasability. Hence, it is desirable that the heating-fixing roller have an outer diameter ϕ equal to or less than 28 mm. The thickness of the elastic layer of the heating-fixing roller is also a parameter for defining the clearance. It was found that a thickness of the elastic layer of less than 0.8 mm lowered the sheet releasability. This is because a small thickness of the elastic layer leads to a small amount of deformation of the elastic layer, so that a recording medium cannot be in an appropriate state at the nip exit. For this reason, it is desirable that the elastic layer have a thickness equal to or more than 0.8 mm. The hardness of the elastic layer of the heating-fixing roller is also a parameter for defining the clearance. It was found that the hardness of the elastic layer of more than 8 Hs (JIS-A) lowered the sheet releasability. The sheet releasability is lowered because a high hardness of the elastic layer leads to a small amount of the deformation of the elastic layer, so that a recording medium cannot be in an appropriate state at the nip exit. For this reason, it is desirable that the elastic layer have a hardness equal to or less than 8 Hs (JIS-A). A large permanent deformation of the pressuring member may cause a temporal change of the nip shape, so that the fixing characteristics of toner to a recording medium and the sheet releasability may be unstable. The test results indicated that a permanent deformation equal to or more than 5% lowered the sheet releasability after the heating-fixing roller was heated and idly rotated for 100 hours or more. For this reason, it is desirable that the pressurizing member have a permanent deformation of equal to or less than 4%.

Figure 4:
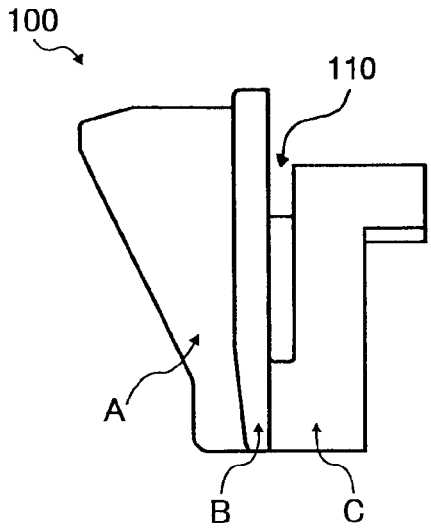
FIG. 4 is a side view of a stationary member of the fixing device.
Figure 6:
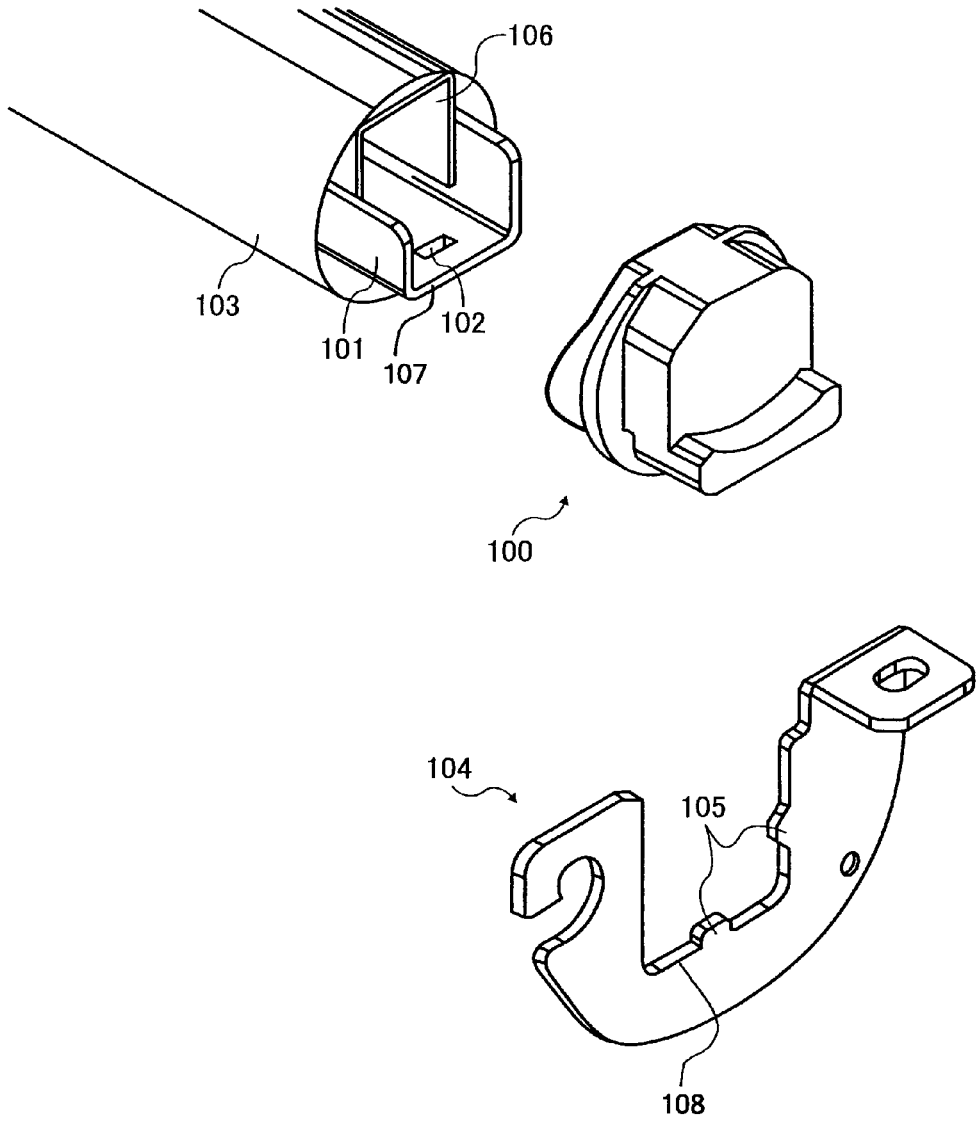
FIG. 6 is a perspective view of a biasing member, the holding member, and the stationary member of a pressurizing unit shown in FIG. 2.

FIG. 6 is a perspective view of a stationary member 100, a holding member 101, and a biasing member 104 of the pressurizing unit 40. FIG. 4 is a side view of the stationary member 100. The stationary member 100 includes three portions A, B, and C. The portion A is in contact with the holding member 101. The portion B prevents an endless member 103 from deviating. The portion C is used to release the pressure applied at the nip portion. The stationary member 100 has a notch 110 between the portions B and C. The biasing member 104 directly presses the holding member 101 at a position where the notch 110 presents to form an appropriate nip portion.

Figure 5:
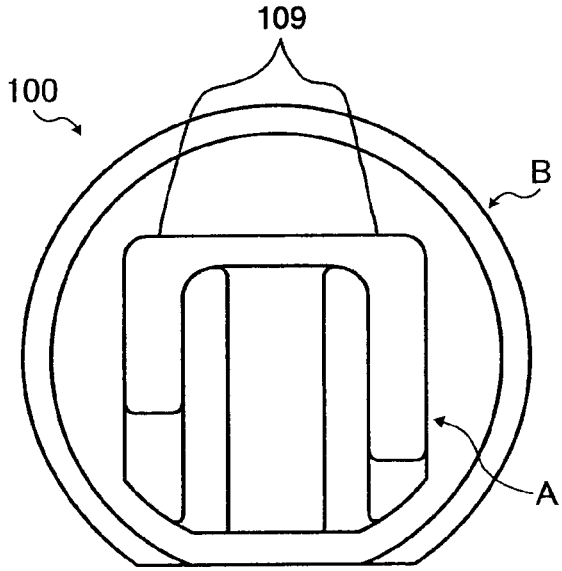
FIG. 5 is a schematic diagram of the stationary member as seen from a surface side that is in contact with a holding member.

FIG. 5 is a schematic diagram of the stationary member 100 as seen from a surface side that is in contact with the holding member 101. The portion A includes a rib 109, whereby the stationary member 100 can be fixed firmly to the holding member 101. This prevents the difference between a direction in which the biasing member 104 presses the holding member 101 and a direction in which the pressurizing member 21 pressurizes the nip portion.

As shown in FIG. 6, the holding member 101 arranged in the loop of the endless member 103 has recesses (holes) 102, and the biasing member 104 has protrusions 105. The holding member 101 and the biasing member 104 are engaged with each other while the protrusions 105 fit into the recesses 102. Alternatively, the holding member 101 can have protrusions, and the biasing member 104 can have recesses. This allows the holding member 101 to be in contact with the biasing member 104 in a larger area. The holding member 101 and the biasing member 104 have a contact surface 107 and a contact surface 108, respectively, by which they contact with each other, so that the holding member 101 can be in contact with the biasing member 104 in a larger area. A pressure-contact member 106 in FIG. 6 corresponds to the pressurizing member 21 in FIGS. 2 and 3.

According to the embodiment, the direction in which the biasing member 104 presses the holding member 101 is the same as the direction in which the holding member 101 presses the pressure-contact member 106. Therefore, it is possible to create sufficient nip pressure between the heating-fixing roller 1' and the endless member 23 shown in FIGS. 2 and 3. Furthermore, the pressure to the holding member 101 from the biasing member 104 is directly applied to the pressure-contact member 106, which suppresses variation in pressure from occurring.

Because the biasing member 104 is in contact with the holding member 101 in a larger area, the direction in which the biasing member 104 presses the holding member 101 is prevented from changing, so that variation of the pressure can be suppressed. With the recesses 102 or protrusions, the holding member 101 can be brought in close contact with the biasing member 104, resulting in still less variation in the pressure. Because the biasing member 104 directly presses the holding member 101, the stationary member 100 can be prevented from being damaged.

The stationary member 100 and the holding member 101 both have contact surfaces by which they contact with each other when engaged. Therefore, the position of the biasing member 104 is prevented from moving, and the endless member 103 is prevented from deviating in a horizontal direction. Thus, a stable nip portion can be formed. In addition, it is possible to prevent the inclination of the holding member 101 due to the accuracy error of the surface of the stationary member 100.

Because the portion C of the stationary member 100 is used to release the pressure at the nip portion, an additional member for releasing the pressure is unnecessary, reducing the size of the fixing device. In addition to the function of preventing the endless member 103 from deviating in the horizontal direction, the stationary member 100 releases the pressure, further reducing the size of the fixing device.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A pressurizing unit that presses an endless member that carries a recording medium, the pressurizing unit comprising:

a pressure-contact member that presses the endless member;

a holding member that holds the pressure-contact member;

a biasing member that presses both ends of the holding member so that a direction in which the biasing member presses the holding member is substantially identical with a direction in which the holding member presses the pressure-contact member; and stationary members that are located on both edges of the endless member, wherein the stationary members each include a first portion that contacts the holding member, a second portion that contacts the endless member on the outside to prevent the endless member from deviating and a notch disposed further outside the second portion at a position where the biasing member presses the holding member directly through the notch provided in the stationary member.

2. The pressurizing unit according to claim 1, wherein the holding member and the biasing member satisfy $H1 \leqq H2$ where H1 is a width of the holding member, and H2 is a width of a surface of the biasing member that is in contact with the holding member.

3. The pressurizing unit according to claim 1, wherein the biasing member extends along side surfaces of the holding member so that the biasing member is in contact with the side surfaces of the holding member.

4. The pressurizing unit according to claim 1, wherein the biasing member includes a protruding member.

5. The pressurizing unit according to claim 4, wherein the holding member includes a recess which engages the protruding member of the biasing member.

6. The pressurizing unit according to claim 1, wherein the holding member and the biasing member both include a flat contact surface by which the holding member and the biasing member contact with each other.

7. The pressurizing unit according to claim 1, further comprising a stationary member that includes a rib which is pressurized by the holding member.

8. A fixing device that fixes a toner image on a recording medium carried on an endless member by heat and pressure, the fixing device comprising:

a heating unit that includes an elastic layer and a heat source;

a pressurizing unit that forms a nip portion with the heating unit through which the recording medium passes, the pressurizing unit including a pressure-contact member that pressurizes the endless member;

a holding member that holds the pressure-contact member;

a biasing member that presses both ends of the holding member so that a direction in which the biasing member presses the holding member is substantially identical with a direction in which the holding member presses the pressure-contact member; and stationary members that are located on both edges of the endless member, wherein the stationary members each include a first portion that contacts the holding member, a second portion that contacts the endless member on the outside to prevent the endless member from deviating and a notch disposed further outside the second portion at a position where the biasing member presses the holding member directly through the notch provided in the stationary member.

9. An image forming apparatus comprising a fixing device that fixes a toner image on a recording medium carried on an endless member by heat and pressure, the fixing device including:

a heating unit that includes an elastic layer and a heat source;

a pressurizing unit that forms a nip portion with the heating unit through which the recording medium passes, the pressurizing unit including a pressure-contact member that pressurizes the endless member;

a holding member that holds the pressure-contact member;

a biasing member that presses both ends of the holding member so that a direction in which the biasing member presses the holding member is substantially identical with a direction in which the holding member presses the pressure-contact member; and stationary members that are located on both edges of the endless member, wherein the stationary members each include a first portion that contacts the holding member, a second portion that contacts the endless member on the outside to prevent the endless member from deviating and a notch disposed further outside the second portion at a position where the biasing member presses the holding member directly through the notch provided in the stationary member.

* * * * *